US006621996B1

(12) United States Patent
Meyer et al.

(10) Patent No.: US 6,621,996 B1
(45) Date of Patent: Sep. 16, 2003

(54) MAGNETIC TONER USE IN A NON-CONTACT CLEANERLESS SYSTEM

(75) Inventors: Brenton L. Meyer, Boise, ID (US); Dennis D. Whitehead, Boise, ID (US); Patrick Dougherty, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/280,442

(22) Filed: Oct. 25, 2002

(51) Int. Cl.[7] ..... G03G 15/00
(52) U.S. Cl. ..... 399/109
(58) Field of Search ..... 399/107, 109, 399/111, 149; 347/138, 152

(56) References Cited

U.S. PATENT DOCUMENTS 5,870,654 A * 2/1999 Sato et al. ..... 399/109
6,041,209 A * 3/2000 Murata ..... 399/313
6,144,824 A 11/2000 Hashimoto et al.
6,400,919 B1 6/2002 Inoue et al.
6,493,526 B2 * 12/2002 Sato ..... 399/109

* cited by examiner

*Primary Examiner*—Susan S. Y. Lee
*Assistant Examiner*—Ryan Gleitz

(57) ABSTRACT

A noncontact cleanerless system toner cartridge that uses an injection charging roller and toner with conductive particles is remanufactured into a conventional toner cartridge. The injection charging roller is removed and replaced with a primary charge roller. A cleaning blade to remove the residual toner from the organic photoconductive drum is added along with a seal to form a toner waste hopper area. The toner with the conductive particles is replaced with toner having magnetic particles.

20 Claims, 4 Drawing Sheets

MAGNETIC TONER USE IN A NON-CONTACT CLEANERLESS SYSTEM

FIELD OF THE INVENTION

The present invention relates generally to laser printers.

BACKGROUND

A conventional technology, laser printer toner cartridge typically uses a statically charged organic photoconductive (OPC) drum that changes charge where it is exposed to light. The drum typically has an evenly distributed negative charge until a laser draws an image or text on it. Those areas of the drum on which the image or text are drawn are now neutrally or positively charged.

A developer roller picks up toner from a toner hopper in the cartridge. The toner contains magnetic particles that are typically negatively charged. As the photoconductive drum rotates past the developer roller, the negative toner particles are attracted and move to the neutral or positive image on the photoconductive drum. The photoconductive drum then transfers the toner particles now moved to the positively charged image on to a negatively charged print media where they are fused in place. A cleaning blade removes the remaining toner particles from the photoconductive drum and places them in a waste hopper. The charges on the surface of the photoconductive drum are then returned to an evenly distributed negative state by contact with a primary charge roller. Newer technology toner cartridges do not use a cleaning blade or waste hopper for removing excess toner from the photoconductive drum. These types of cartridges are typically referred to in the art as noncontact cleanerless cartridges.

SUMMARY

The present invention encompasses a method for converting a cleanerless toner cartridge to a conventional toner cartridge. The method comprises removing an injection charging roller from an injection charging roller area in the cartridge. A primary charge roller is added in place of the injection charging roller. A cleaning blade is added such that the cleaning blade is close enough to an organic photoconductive drum in the cartridge to remove toner material into the injection charging roller area. The cleanerless toner that has conductive particles is replaced with toner that has magnetic particles.

Further embodiments of the invention include methods and apparatus of varying scope.

DETAILED DESCRIPTION

In the following detailed description of the present embodiments and the prior art, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

The embodiments of the present invention provide for conversion of a cleanerless toner cartridge to be remanufactured into a conventional toner cartridge with minimal component changes. This is accomplished by removing the injection charging roller and replacing it with a primary charge roller, cleaning blade, and waste hopper and replacing the conductive toner with magnetic toner.

Figure 1:
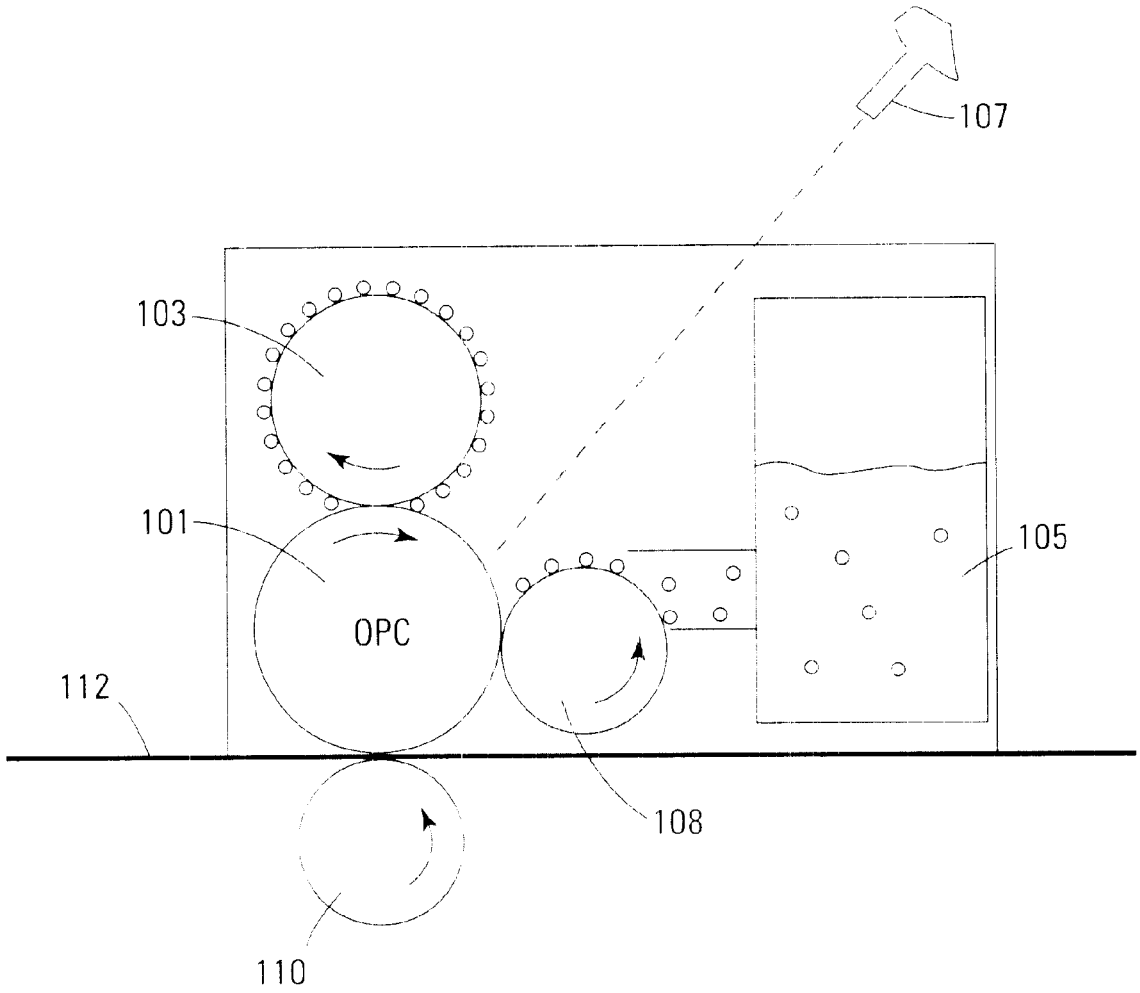
Fig. 1 Prior Art
FIG. 1 shows a cut-away view of a typical prior art cleanerless system toner cartridge.

FIG. 1 illustrates a typical prior art noncontact cleanerless system toner cartridge.

The organic photoconductive drum (101) in a cleanerless cartridge relies on an injection layer on its surface which is conductive and an injection charge roller (103) that is larger than a typical primary charge roller and is covered with conductive particles to evenly charge the organic photoconductive drum's surface. The injection charge roller rotates such that it oppositely brushes the surface of the organic photoconductive drum. This aids in charging and provides a cleaning effect by removing the non-transferred toner and residual conductive particles from the organic photoconductive drum. A developer roller (108) picks up toner (105) from the toner storage. The image or text is drawn on the organic photoconductive drum (101) with a laser (107). The toner is then attracted to the organic photoconductive drum (101) where it has been exposed to the light of the laser.

The image is transferred to the print medium (112), such as paper, as described above. A transfer roller (110) changes the charge on the print medium as the medium is moved between the organic photoconductive drum (101) and the transfer roller (110).

The cleanerless system toner cartridge of FIG. 1 does not require a cleaning blade or waste hopper. Without these parts, the cleanerless cartridge can be made smaller and less expensive than the conventional technology toner cartridge.

A situation exists with the newer technology toner cartridges in that the magnetic toner and parts from the conventional technology toner cartridges are more readily available than the newer technology toner and parts. Even though toner cartridges exist that have the same smaller size and shape as the newer technology toner cartridges while using the conventional technology toner and parts, a need exists in the art for a method to remanufacture a newer technology toner cartridge into a toner cartridge that uses conventional toner and parts.

Figure 2:
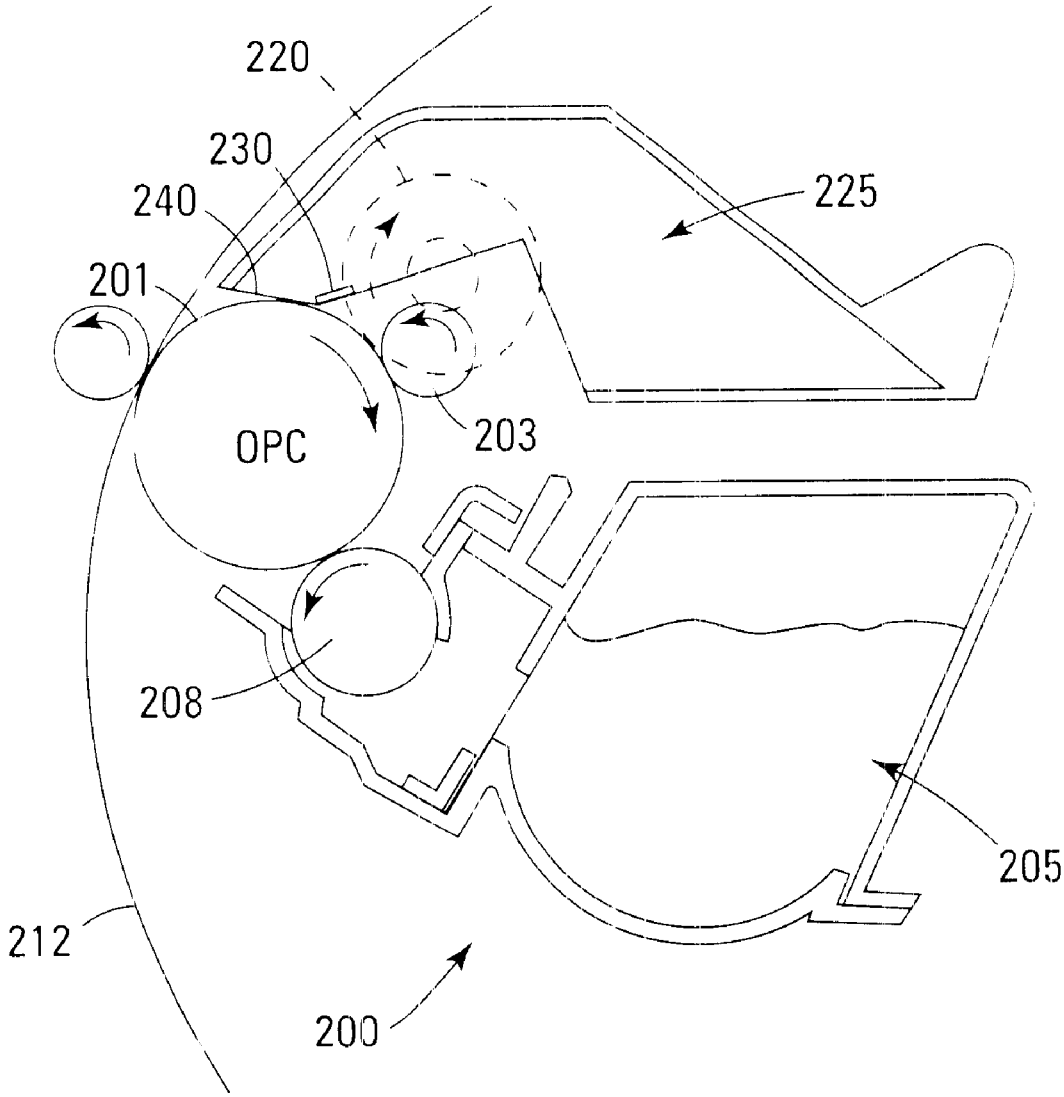
FIG. 2 shows a cut-away view of a remanufactured toner cartridge in accordance with one embodiment of the present invention.

FIG. 2 illustrates a cut-away view of one embodiment of a remanufactured toner cartridge of the present invention. This embodiment starts with a typical cleanerless cartridge that undergoes a conversion process to become a conventional toner cartridge that uses conventional toner and conventional toner cartridge components.

In the embodiment of FIG. 2, the larger injection charging roller of the cleanerless system is removed and replaced with the smaller, conventional primary charge roller (203). The cleanerless injection charging roller is typically a 20 mm diameter conductive foam roller. In one embodiment, this is replaced with a 12 mm diameter hard rubber primary charge roller (203) for the conventional toner cartridge conversion. The removed injection charging roller (220) is shown in dotted lines to indicate its location prior to removal.

The removal of the larger injection charging roller (220) frees up space in the upper portion of the cartridge (200) to create or fit a toner waste hopper (225) and the cleaning blade (230). The cleaning blade (230) skims along the surface of the organic photoconductive drum (201) to remove the remaining toner that was not transferred to the print medium. The toner removed from the organic photoconductive drum (201) is placed in the waste hopper (225).

In one embodiment, the waste hopper (225) uses the space remaining after the injection charging roller (220) is removed. In such an embodiment, the waste hopper (225) is a bounded area formed by the walls of the cartridge (200), the cleaning blade (230), and a blow out seal (240) that is inserted prior to the cleaning blade (230) over the organic photoconductive drum (201). Since the majority of the toner from the organic photoconductive drum (201) is transferred to the print medium (212) during the printing process, the toner waste hopper does not require a large space.

In an alternate embodiment, the waste hopper (225) is formed by an individual component being inserted into the space left by the removed injection charging roller (220). Such a hopper (225) may be formed from substantially similar plastic of which the toner cartridge (200) is formed.

The cleanerless toner system uses a toner that has conductive particles in the toner hopper (205). This is replaced with toner having magnetic particles that is typically used in conventional toner cartridges.

In the embodiment of FIG. 2, the remaining components of the cartridge (200) are not changed. For example, the toner hopper (205) that feeds toner to the developer roller (208) remains unchanged. The photoconductive drum (201) could be changed or left as is.

The location and orientation of the components of the remanufactured cartridge (200) of FIG. 2 are for illustration purposes only. Alternate embodiments may orientate the waste hopper and cleaning blade differently while achieving substantially similar results.

For purposes of clarity, not all of the components of the toner cartridge (200) are illustrated. For example, one embodiment of the toner cartridge (200) uses a toner mixer in the toner hopper to keep the toner mixed and a toner level sensor to determine when the toner is getting low and the cartridge should be replaced.

Figure 3:
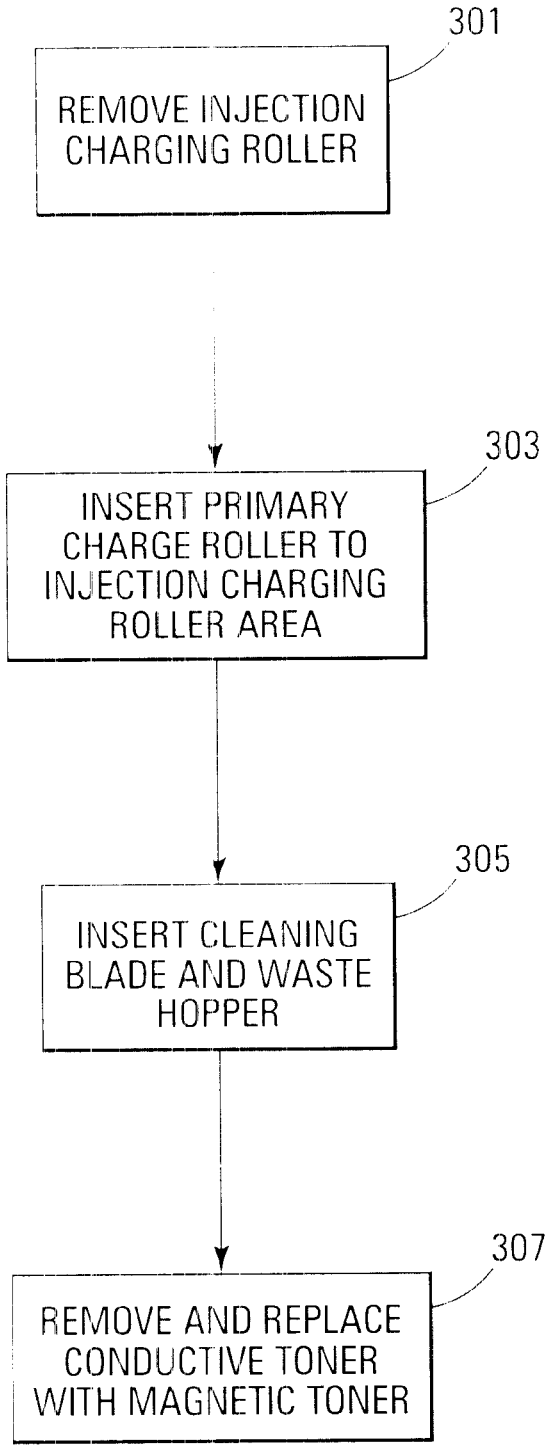
FIG. 3 shows a flowchart of a remanufacturing method of a cleanerless system toner cartridge in accordance with one embodiment of the present invention.

FIG. 3 illustrates a flowchart of one embodiment of the remanufacturing method of the present invention. The larger injection charging roller is removed (301) to make room for the smaller primary charge roller (303) of a conventional toner cartridge. The removal of the larger injection charging roller also creates room to insert a toner waste hopper and cleaning blade (305) for the conventional magnetic toner.

The conductive toner of the cleanerless system is removed and replaced with the magnetic toner (307) that is used in conventional toner cartridges. This type of toner uses the cleaning blade and toner waste hopper of the conventional toner cartridges.

The embodiment illustrated in FIG. 3 is for illustration purposes only. The present invention is not limited to any one order for the steps of remanufacturing the cartridge.

Figure 4:
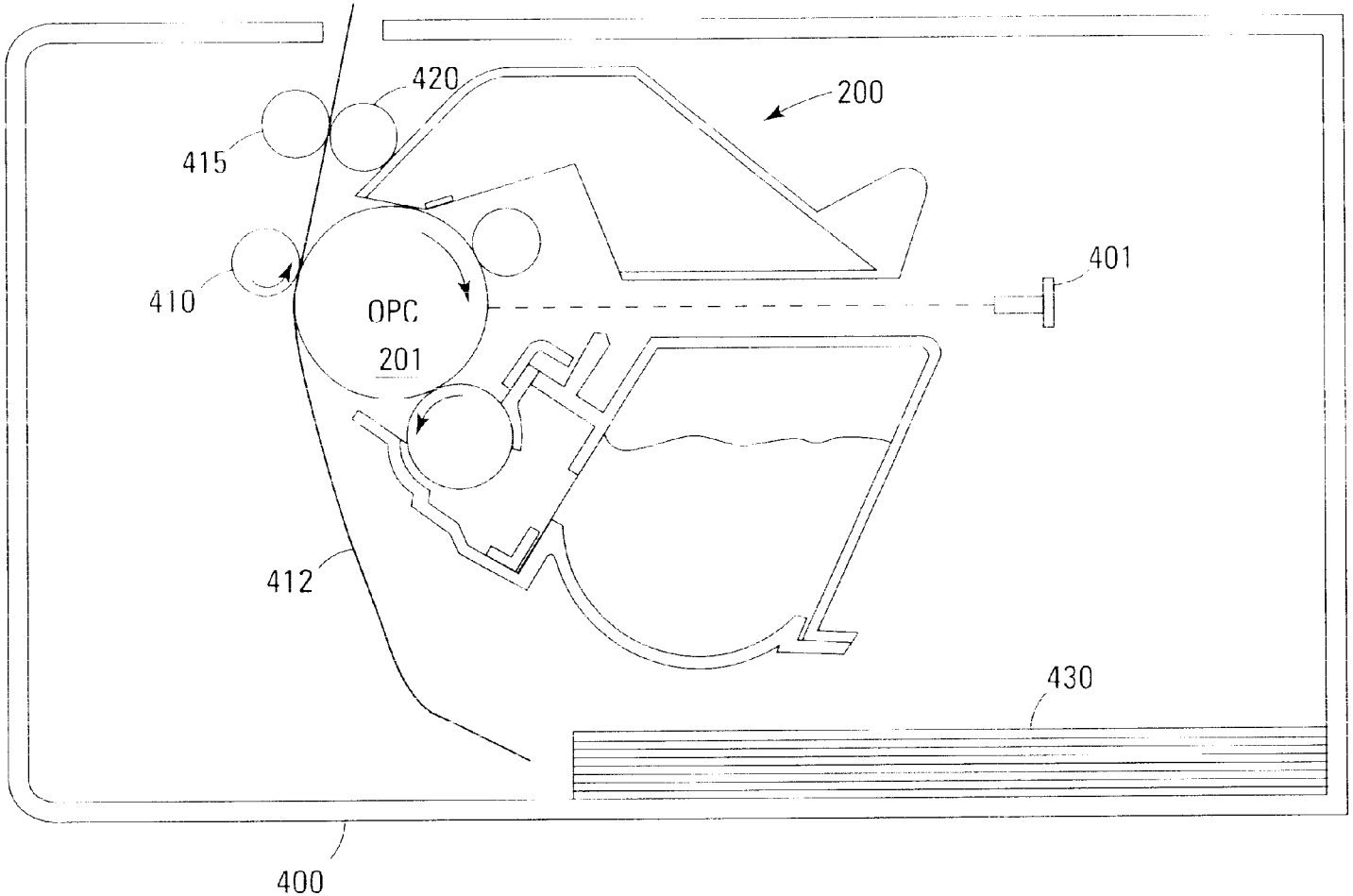
FIG. 4 shows a cut-away view of a laser printer that incorporates the remanufactured toner cartridge of FIG. 2 in accordance with one embodiment of the present invention.

FIG. 4 illustrates one embodiment of a laser printer (400) in accordance with the remanufactured toner cartridge (200) of the present invention. The toner cartridge (200) fits into the laser printer (400) such that print medium (412) from the print media holder (430) is transported past the organic photoconductive drum.

The laser (401) interacts with the organic photoconductive drum (201) in a substantially similar manner as before the conversion process by drawing the text or image on the drum (201). A transfer roller (410) transfers a positive charge to the underside of the print medium (412) as it moves past the organic photoconductive drum (201). This charge attracts the negatively charged toner in the locations drawn on the organic photoconductive drum (201) by the laser (401).

A fuser roller (420) melts the toner to bond it to the print medium (412). As the toner is melting, a pressure roller (415) applies pressure to the print medium (412) using the fuser roller (420). The printed sheet of print medium is then deposited out of the printer.

The laser printer of FIG. 4 is for purposes of illustration only. The operation of the remanufactured toner cartridge of the present invention is not limited to any one laser printer.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A method for converting a cleanerless toner cartridge to a conventional toner cartridge having an organic photoconductive drum, the method comprising:

removing an injection charging roller from an injection charging roller area;

replacing the injection charging roller with a primary charge roller having a smaller diameter than the injection charging roller;

adding a cleaning blade adapted to remove toner material from a surface of the organic photoconductive drum into the injection charging roller area; and adding toner having magnetic particles.

2. The method of claim 1 wherein the primary charge roller is added substantially in the injection charging roller area.

3. The method of claim 1 further comprising adding a seal to create a toner waste hopper substantially in the injection charging roller area.

4. The method of claim 1 further comprising adding a toner waste hopper substantially in the injection charging roller area.

5. The method of claim 1 wherein the primary charge roller is a hard rubber roller having a diameter substantially close to 12 millimeters.

6. The method of claim 1 wherein the primary charge roller imparts a negative charge to the organic photoconductor drum.

7. A method for creating a remanufactured conventional toner cartridge from a cleanerless toner cartridge having an organic photoconductive drum, the method comprising:

removing an injection charging roller from an injection charging roller area;

adding a primary charge roller substantially in the injection charging roller area;

adding a cleaning blade such that the cleaning blade is close enough to the organic photoconductive drum to remove toner material from the organic photoconductive drum;

adding a seal between the organic photoconductive drum and a wall of the toner cartridge to form, with the cleaning blade, a toner waste hopper area; and replacing toner having conductive particles with toner having magnetic particles.

8. The method of claim 7 further comprising inserting a toner waste hopper in the toner waste hopper area.

9. A method for creating a remanufactured conventional toner cartridge from a cleanerless toner cartridge having an organic. photoconductive drum, the method comprising:

removing an injection charging roller from an injection charging roller area;

adding a primary charge roller substantially in the injection charge roller area;

creating a toner waste hopper area by adding a cleaning blade and a seal that, in combination with the organic photoconductive drum, form a bounded area into which excess toner from the organic photoconductive drum is removed by the cleaning blade; and replacing toner having conductive particles with toner having magnetic particles.

10. A method for converting a remanufactured toner cartridge that has been converted from a cleanerless toner cartridge to a conventional toner cartridge having an organic photoconductive drum, the method comprising:

removing an injection charging roller from an injection charging roller area;

adding a primary charge roller;

adding a cleaning blade such that the cleaning blade is close enough to the organic photoconductive drum to remove toner material into the injection charging roller area; and replacing toner having conductive particles with toner having magnetic particles.

11. The method of claim 10 further comprising adding a seal between the organic photoconductive drum and a wall of the cartridge to form a toner waste hopper substantially in the injection charging roller area.

12. A laser printer comprising:

a laser; and a toner cartridge, wherein the toner cartridge is remanufactured using a method comprising:

removing an injection charging roller from an injection charging roller area;

adding a primary charge roller substantially in the injection charge roller area;

creating a toner waste hopper area by adding a cleaning blade and a seal that, in combination with an organic photoconductive drum, form a bounded area into which excess toner from the organic photoconductive drum is removed by the cleaning blade; and replacing toner having conductive particles with toner having magnetic particles.

13. The laser printer of claim 12 further comprising a waste hopper in the waste hopper area.

14. A remanufactured toner cartridge comprising:

an organic photoconductive drum; and a remanufactured area that has been modified using a remanufacturing method comprising:

removing an injection charging roller from an injection charging roller area;

adding a primary charge roller;

adding a cleaning blade such that the cleaning blade is close enough to the organic photoconductive drum to remove toner material into the injection charging roller area; and replacing toner having conductive particles with toner having magnetic particles.

15. A method for creating a remanufactured conventional toner cartridge from a cleanerless toner cartridge having an organic photoconductive drum, the method comprising:

removing an injection charging roller from an injection charging roller area;

replacing the injection charging roller with a primary charge roller, having a smaller diameter than the injection charging roller, substantially in the injection charging roller area;

adding a cleaning blade such that the cleaning blade is close enough to the organic photoconductive drum to remove toner material from the organic photoconductive drum; and adding a seal between the organic photoconductive drum and a wall of the toner cartridge to form, with the cleaning blade, a toner waste hopper area.

16. A remanufactured toner cartridge comprising:

means for holding a toner material comprising magnetic particles;

means for depositing the toner material on photoconductive drum;

means for removing excess toner material from the photoconductive drum;

an area for collecting the excess toner material; and means for balancing a charge polarity on the photoconductive drum, wherein at least the means for removing the excess toner and the means for balancing the charge polarity are positioned in an area previously occupied by a larger means for balancing the charge polarity.

17. The remanufactured toner cartridge of claim 16 further comprising means for sealing the area for collecting the excess toner material.

18. The remanufactured toner cartridge of claim 17 wherein the means for sealing and the means for removing the excess toner form a means for collecting the excess toner material.

19. The remanufactured toner cartridge of claim 16 wherein the larger means for balancing the charge polarity comprises a conductive foam roller.

20. The remanufactured toner cartridge of claim 16 wherein the means for balancing the charge polarity comprises a hard rubber roller.

* * * * *

UNITED STATES PATENT AND TRADEMARK OFFICE

CERTIFICATE OF CORRECTION

PATENT NO. : 6,621,996 B1 
DATED : September 16, 2003
INVENTOR(S) : Meyer et al.

It is certified that error appears in the above-identified patent and that said Letters Patent is hereby corrected as shown below:

Column 5,
Line 14, delete “organic.” and insert therefor -- organic --.

Signed and Sealed this

Twentieth Day of April, 2004

JON W. DUDAS
*Acting Director of the United States Patent and Trademark Office*